United States Patent [19]

Huntley et al.

[11] 3,941,020

[45] Mar. 2, 1976

[54] APPARATUS FOR CUTTING WORKPIECES SUCH AS COMPONENTS FOR MITERED CORNER PICTURE FRAMES WITH MINIMUM WASTE

[75] Inventors: James R. Huntley; William Franklin Southard, both of Monroe, N.C.

[73] Assignee: James R. Huntley, Monroe, N.C.

[22] Filed: Feb. 27, 1975

[21] Appl. No.: 553,839

[52] U.S. Cl. ..... 83/468; 83/477; 83/477.2

[51] Int. Cl.[2] ..... B26D 7/16; B26D 1/14

[58] Field of Search ..... 83/468, 477, 477.2, 764

[56] References Cited

UNITED STATES PATENTS

| | | | |
|---|---|---|---|
| 3,059,674 | 10/1962 | Boling | 83/468 |
| 3,888,152 | 6/1975 | Barton | 83/477 X |

*Primary Examiner*—Willie G. Abercrombie

*Attorney, Agent, or Firm*—Parrott, Bell, Seltzer, Park & Gibson

[57] ABSTRACT

Apparatus for easily and quickly cutting with mininum waste workpieces, such as components for making mitered corner picture frames, from an elongate strip of material of any predetermined width, in which each workpiece has opposing ends which are equally and oppositely angled with respect to each other and an inside edge of predetermined length, as follows. A guide device positions the elongate strip of material at desired positions along a longitudinally extending axis. A saw makes spaced, successive, angular, parallel cuts through the elongate strip to form workpieces with parallel angular cut ends and thereafter cuts off and removes a wastepiece from one end of each cut workpiece by making an oppositely angled cut. A device is associated with the guide device and the saw for (1) providing a stop for properly positioning the strip of material regardless of the width thereof before each cut for making the next workpiece and (2) measuring the ultimate desired inside edge length of each workpiece to be cut from the strip of material while compensatively adding the necessary additional inside edge length to the workpiece being cut to provide an initially cut workpiece of the proper combined inside edge length for the subsequent cutting off of only a minimum waste, triangular shaped wastepiece which removes the additional inside edge length.

13 Claims, 7 Drawing Figures

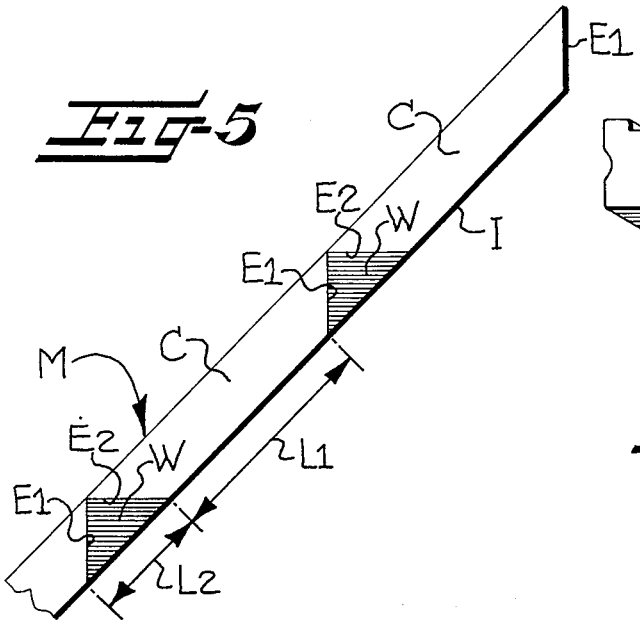
Fig-5
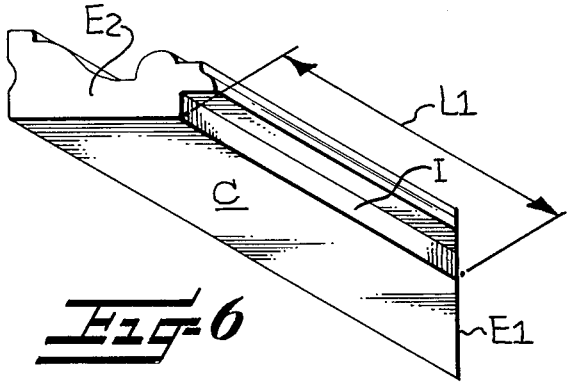
Fig-6
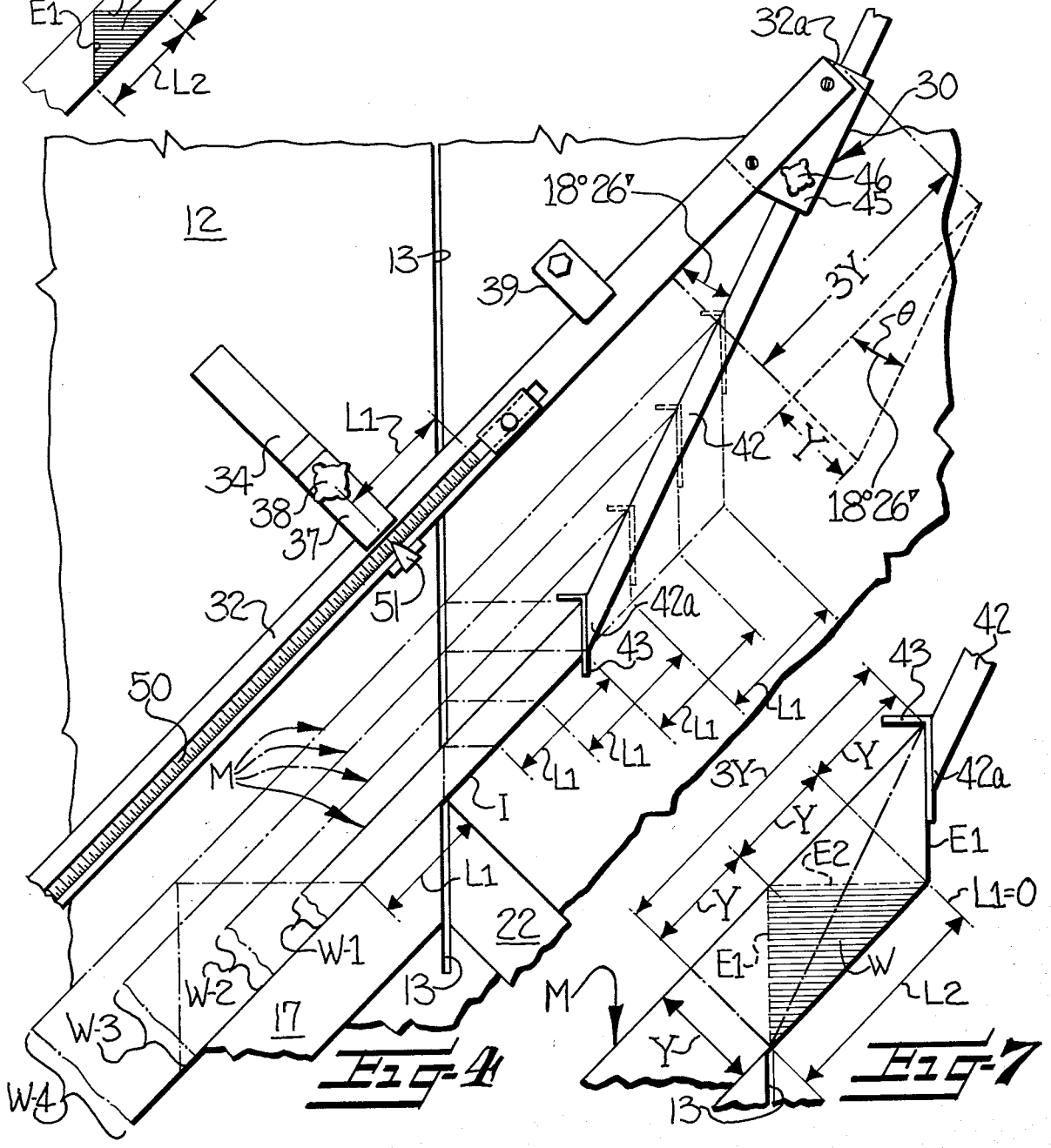
Fig-4
Fig-7

APPARATUS FOR CUTTING WORKPIECES SUCH AS COMPONENTS FOR MITERED CORNER PICTURE FRAMES WITH MINIMUM WASTE

This invention relates to an apparatus for easily and quickly cutting with minimum waste workpieces, such as components for making mitered corner picture frames, from an elongate strip of material of any predetermined width, in which each workpiece has opposing ends which are equally and oppositely angled with respect to each other and an inside edge of predetermined desired length.

BACKGROUND OF THE INVENTION

In the manufacture and cutting of picture frame molding components or the like workpieces having opposing ends which are equally and oppositely angled with respect to each other and an inside edge of predetermined desired length from an elongate strip of material for purposes of building a mitered end picture frame or other frame device, various problems have been presented in these manufacturing and cutting operations to provide the desired inside edge length on the components or workpieces while reducing waste of the material being cut. These oppositely angled ends are normally of oppositely extending angles of 45° for forming 90° mitered corners in the overall picture frame or other frame being produced; however, other oppositely angled cut ends may be desired for the building of picture frames or other frames having other than a 90° mitered corner.

In the manufacture and cutting of such picture frame molding components or the like workpieces from an elongate strip of material, it is the usual practice to make spaced, successive, parallel cuts through the elongate strip to form workpieces with parallel angular cut ends. A wastepiece is then cut off and removed from one end of each workpiece by making an oppositely angled cut. The main problem with this operation and the apparatus heretofore available therefor is in determining where to make the various cuts to allow for removal of a wastepiece for providing an ultimate inside edge on the workpiece of a predetermined desired length. Accordingly, this operation has necessarily required lengthy measuring and handling procedures. Also, this operation has often resulted in undesirably large wastepieces which render the cutting and manufacturing operation inefficient from a standpoint of maximum utilization of the strip of material being used. Clearly, the least waste would result from the cutting off and removal of only a triangular shaped wastepiece.

While the various miter box cutting devices for the cutting of picture frame molding components or the like workpieces having opposing ends which are equally and oppositely angled with respect to each other have been provided, none of these devices have included any provision or any mechanisms for easily and quickly measuring the ultimate desired inside edge length of each workpiece to be cut from the strip of material while compensating for the wastepiece to be removed from each workpiece.

SUMMARY OF THE INVENTION

Accordingly, it is the object of this invention to provide an apparatus for easily and quickly cutting with minimum waste workpieces, such as components for making mitered corner picture frames, from an elongate strip of material of any predetermined width, in which each workpiece has opposing ends which are equally and oppositely angled with respect to each other and an inside edge length of predetermined length and which overcomes the problems presented with previously proposed apparatus.

It is a further more specific object of this invention to provide the above apparatus with specific means for measuring the ultimate desired inside edge length of each workpiece to be cut from the strip of material while compensating for the necessary additional inside edge length for each initially cut workpiece for the subsequent cutting off and removal of only a minimum size wastepiece.

It has been found by this invention that the above objects may be accomplished broadly by providing such apparatus which includes the following: Guide means are provided for positioning an elongate strip of material at desired positions along a longitudinally extending axis. Saw means cooperate with the guide means for making spaced, successive, angular, parallel cuts through the elongate strip to form workpieces with parallel angular cut ends and for thereafter cutting off and removing a wastepiece from one end of each cut workpiece by making an oppositely angled cut. Means are operatively positioned and associated with the guide means and the saw means for (1) providing a stop for properly positioning the strip of material regardless of the width thereof before each cut for making the next workpiece, and (2) measuring the ultimate desired inside edge length of each workpiece to be cut from the strip of material while compensatively adding the necessary additional inside edge length to the workpiece being cut to provide an initially cut workpiece of the proper combined inside edge length for the subsequent cutting off of only a minimum waste, triangular shaped, wastepiece which removes the additional inside edge length.

Further details of the specific, preferred construction of the above described apparatus and the method of this invention will be described more specifically in the detailed description to follow.

BRIEF DESCRIPTION OF THE DRAWINGS

Some of the objects and advantages of this invention having been set forth, other objects and advantages will appear as the description proceeds when taken in conjunction with the accompanying drawings, in which:

FIG. 4 is a somewhat schematic, enlarged, partial, top plan view of a portion of the apparatus of FIGS. 1 and 2 and illustrating various width workpieces therein;

FIG. 5 is a top plan view of an elongate strip of material illustrating in cross hatched sections the wastepieces to be removed therefrom in cutting of the components;

FIG. 6 is a perspective view taken generally from the bottom inside of a picture frame molding component cut by the apparatus and method of this invention; and FIG. 7 is a somewhat schematic, partial, top plan view of the strip of material as positioned in the cutting off of a component which would have an ultimately zero inside edge length.

DESCRIPTION OF PREFERRED EMBODIMENT

Figure 1:
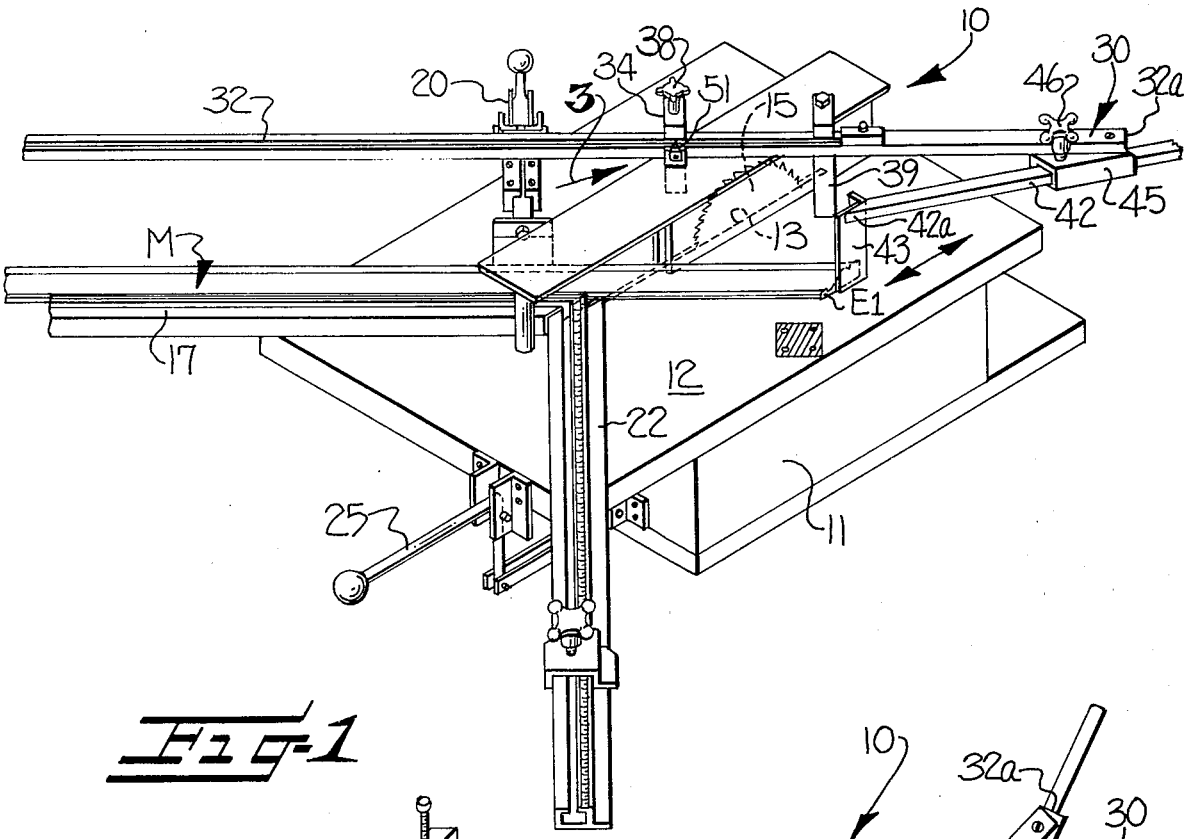
FIG. 1 is a perspective view of an apparatus in accordance with this invention.

Referring now to the drawings, an apparatus, broadly indicated at 10, is illustrated for cutting workpieces, such as picture frame molding components C (see FIG. 6) or the like, having opposing cut ends E1 and E2 which are equally and oppositely angled and having in accordance with this invention stop and measuring means, broadly indicated at 30, in combination therewith. The pixture frame molding component cutting apparatus 10 illustrated in the drawings is specifically of the type set forth in copending U.S. Pat. application, Ser. No. 534,434, filed Dec. 19, 1974.

It is to be understood that while this specific picture frame molding component cutting apparatus 10 illustrated in the drawings is the preferred form to be utilized in combination with the stop and measuring means 30, other specific picture frame molding component cutting apparatus may be utilized with the adjustable measuring and stop means 30. Also, the picture frame molding component cutting apparatus 10 is specifically constructed for the cutting of 45°, oppositely angled, cut ends on picture frame moldings for the formation of 90° mitered corners in the picture frames constructed; however, the apparatus 10 could be varied somewhat for the cutting of other oppositely angled cut end components which may be picture frame molding components or other workpieces in which mitered corners of various angles are desired to be formed.

The component cutting apparatus 10 broadly includes a support frame structure 11 of any convenient construction and formed of any suitable materials. A table top 12 is suitably linearly movably mounted on the support frame structure 11 for linear movement of the table top 12 back and forth on the support frame structure 11 (as indicated by the arrow in FIG. 1). The table top 12 includes a longitudinally extending slot 13 therein generally medially thereof. A rotating, circular saw 15 is mounted in fixed position on the support frame structure 11 and positioned within a portion of the slot 13 so that the table top 12 may be moved linearly back and forth with respect to the saw 15 for cutting operations.

Figure 2:
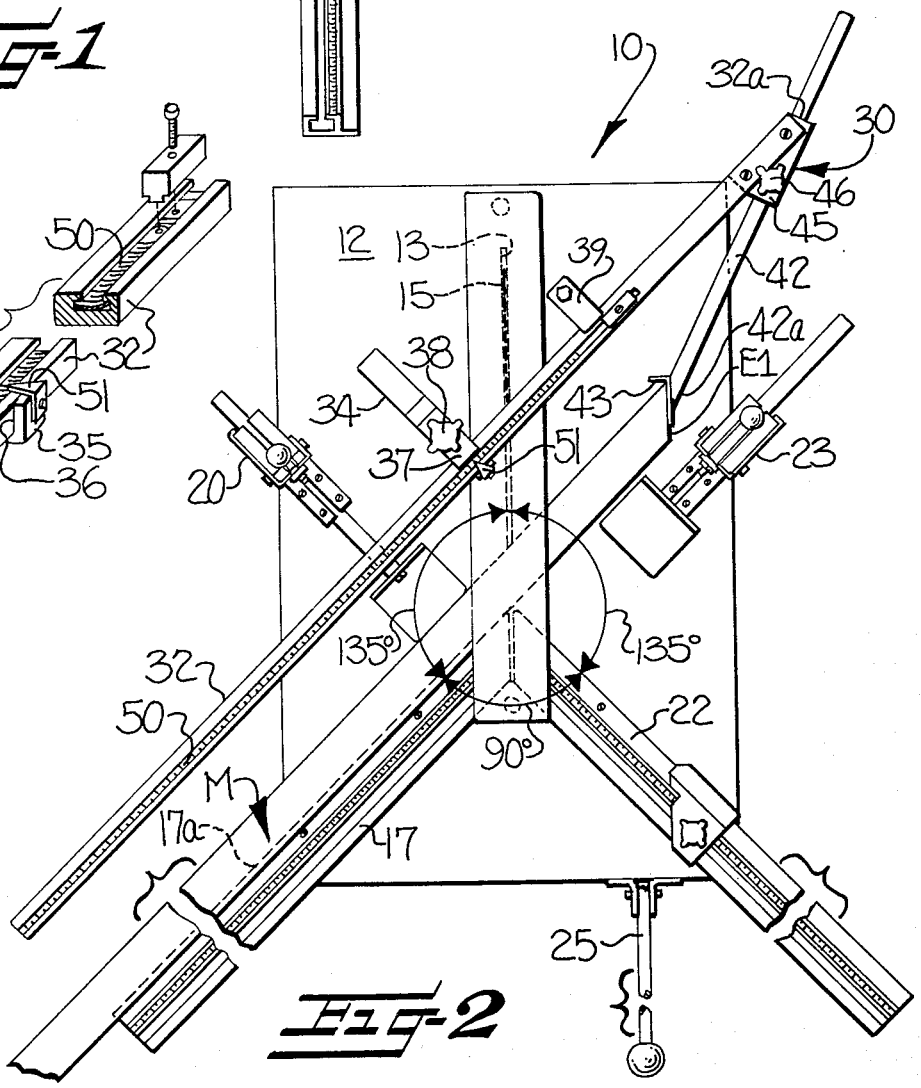
FIG. 2 is a top plan view of the apparatus of FIG. 1.

A guide means in the form of a first longitudinally extending backstop means 17 is secured to the table top 12 and extends outwardly therefrom at a substantially 135° included angle with respect to the table top slot 13 and the saw 15 for receiving the inside edge of a strip of material M thereagainst and positioning the strip of material M along a longitudinally extending axis at the same angle with respect to the saw 15 (as shown in FIGS. 1, 2 and 4) for movement of the table top 12 and the strip of material M linearly toward the saw 15 for making spaced, successive, parallel, 45° cuts through the elongate strip of material M along the length thereof as the leading edge of the strip of material M is progressively moved outwardly along the longitudinal axis to form workpieces or components C with parallel 45° cut ends (indicated schematically at E1 in FIG. 5).

The backstop means 17 may be suitably constructed with an outwardly, transversely and longitudinally extending flange 17*a* (as shown in FIG. 2) for aiding in positioning of certain configurations of picture frame material M having rabbeted inside edges I (as shown in FIG. 6) in which case the inside edge to be measured and considered with respect to the further features of this invention is the inside of the rabbeted edge. Accordingly, when further reference is made to the inside edge of the cut picture frame molding component C, this is intended to mean the inside of the rabbeted edge if a rabbeted edge is presented.

The component cutting apparatus 10 further includes a first releasable clamp device 20 mounted on the table top 12 for being selectively positioned in engagement with the outside edge of the strip of material M received by the first backstop means 17 for clamping the strip of material against the first backstop means 17 during each cutting operation by the saw 15.

There is further provided another guide means in the form of a second longitudinally extending backstop means 22 secured to the table top 12 and disposed at a substantially 135° included angle with respect to the table top slot 13 and the saw 15 and at a substantially 90° included angle with respect to the first backstop means 17 for receiving the inside edge of each of the cut components C having the parallel cut ends E1 thereon after having been cut from the strip of material M and positioning the component C at substantially the same 135° included angle with respect to the saw 15 for movement of the table top 12 and the component C linearly toward the saw for making an oppositely angled 45° cut at one end of the component to cut off and remove a wastepiece W to form an oppositely angled outwardly extending 45° cut end E2 at the one end of the component C, (as indicated schematically in FIG. 5).

A second releasable clamp device 23 (shown in FIG. 2 and removed in FIG. 1 for clarity) is mounted on the table top 12 for being selectively positioned in engagement with the outside edge of the cut component C received by the second backstop means 22 for clamping the cut component C against the second backstop means 22 during the cutting operation thereof. A handle and lever mechanism 25 is provided for manual movement of the table tap 12 linearly back and forth with respect to the saw 15.

Further details of construction and operation of the picture frame molding component cutting apparatus 10, described broadly above, may be had by reference to the aforesaid copending patent application.

In accordance with the present invention, the above described picture frame molding component cutting apparatus 10 is provided with a stop and measuring means 30 carried by the table top 12 and operatively positioned and associated with the guide means of first backstop means 17 and the saw 15 for (1) providing a stop for properly positioning the strip of material M regardless of the width thereof before each 45° cut for making the next workpiece or component C, and (2) measuring the ultimate inside edge length (indicated schematically at L1 in FIG. 5) of each workpiece or component C to be cut from the strip of material M while compensatively adding the necessary additional inside edge length (indicated at L2 in FIG. 5) to the component C being cut to provide an initially cut component C of the proper combined inside edge length (L1 + L2) for the subsequent cutting off of only a minimum waste, isosceles right triangular shaped, wastepiece W which removes the additional inside edge length L2.

Figure 3:
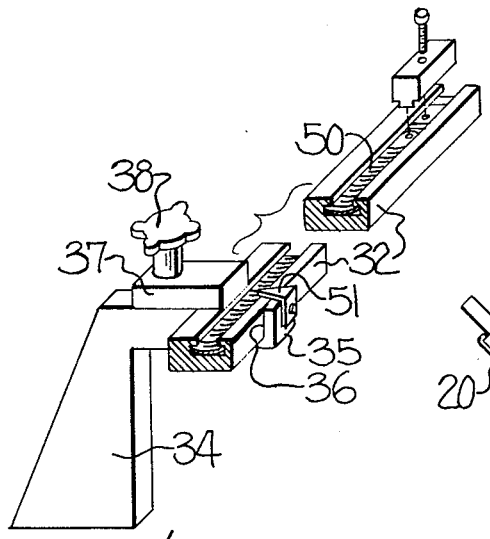
FIG. 3 is a perspective detail, broken away, of a portion of the apparatus of FIG. 1 and taken generally at the arrow 3 of FIG. 1.

This stop and measuring means 30 comprises a first elongate leg member 32 adjustably mounted along an outwardly longitudinally extending axis parallel with the axis along which the strip of material M is positioned by the guide means or first backstop means 17 and having an outer end 32*a*. As may be seen, this first leg member 32 is mounted on the table top 12 by an upstanding bracket 34 (see FIG. 3) which is secured to the table top 12 and includes an inwardly extending arm 35 having a slot 36 therethrough for receipt of the leg member 32. A plate 37 is provided on the top of the arm 35 of the bracket 34 for extending over and clamping the leg member 32 in its adjusted position by tightening of a threaded knob device 38. A similar stabilizing bracket 39 is also secured to the table top 12 for receiving and supporting the leg 32. Thus, the leg 32 may be adjusted outwardly and inwardly along its longitudinally extending axis, for purposes to be described below.

The stop and measuring means 30 further includes a second elongate leg member 42 connected with the first leg member 32 at the outer end 32*a* and is adjustably mounted along an inwardly longitudinally extending axis disposed at an included angle of approximately 18° 26′ with the axis along which the first leg member 32 is positioned. The second leg member includes an inner end 42*a* which may include a bracket 43 secured thereto for receiving and acting as an abutment stop for the outer corner of the leading cut end of the strip of material M as it is progressively moved outwardly along its longitudinal axis for properly positioning the strip of material M for making the next parallel cut therethrough to separate a cut component C having parallel cut ends E1 from the strip of material M, as described above. The second leg member 42 is connected to the outer end 32*a* of the first leg member 32 by a collar 45 secured to the end 32*a* of the first leg member 32 and which telescopingly receives the second leg member 42 for inward and outward linear adjustment along the axis of the second leg member 42. A threaded adjustment knob device 46 is provided in the collar 45 for securing the second leg means 42 in its adjusted position.

With the above construction, when the first leg member 32 is adjustably positioned along its axis in relation to the desired inside length L1 of the component C being cut from the elongate strip of material M and the second leg member 42 is adjustably positioned along its axis in relation to the width of the strip of material M being cut for aligning with the outer corner of the leading cut end of the strip of material, the strip of material M will be properly positioned for making the next component C. Since the first leg member 32 is mounted along an axis parallel with the axis along which the strip of material M is positioned and is adjustably positioned at an outwardly extending position related to the desired inside edge length L1 of the component C and since the second leg member 42 is mounted at an included angle of 18° 26′ with the first leg member and is adjustably positioned along its axis for abutting with the leading corner of the strip of material M, the strip of material M will be properly positioned for cutting so that the necessary additional inside edge length L2 is compensatively added to the inside edge length L1 to provide an initially cut component of the initial proper inside edge length of L1 + L2 for the subsequent cutting off and removing of only a minimum waste, isosceles right triangular, wastepiece W which removes the additional inside edge length of L2.

To provide a visual indication for adjustment of the first leg member 32 to the desired position along its axis in relation to the desired inside edge length L1 of the component C being cut, the leg member 32 is formed with a longitudinally extending, generally C-shape in cross-section, open sided slot on the upper surface thereof for receipt therein of an elongate scale 50. Also, the bracket 34 may include a pointer 51 overlying the scale 50 and secured to the outwardly extending portion 35 thereof.

As indicated schematically in FIG. 4, the first leg member 32 will be moved outwardly until a length L1 is indicated on the scale 50. The second leg member 42 is then adjusted inwardly or outwardly until it mates with the leading corner of the strip of material M regardless of the width thereof. For purposes of illustration, various width strips of material have been indicated schematically in FIG. 4 and labeled as W1, W2, W3 and W4. As may be seen in FIG. 4, when the leg member 42 is adjustably positioned to abut with the leading corner of the widest W4 strip of material M shown therein, the leg members 32 and 42 form a right triangle in which one side is of a length Y and the other side is of a length 3Y. The included angle $\theta$ of this triangle which would relate to the included angle between the leg members 32 and 42 may be mathematically determined by:

$$\text{tangent } \theta = \frac{Y}{3Y} = \frac{1}{3} = .333$$

$$\theta = 18° \, 26'$$

The above relationship of one side of the triangle equaling Y and the other side equaling 3Y will be true for any of the positions of the second leg member 42 shown schematically in FIG. 4 for the various width W1, W2, W3, W4 strips of material M. Thus, the included angle of 18° 26′ for the first and second leg members 32, 42 will result in abutment of the inner end 42*a* of the leg member 24 with the leading corner of the strip of material M only at the desired position for compensatively adding the necessary additional length L2 to the inside edge I of the component C being cut to thereafter remove an isosceles right triangular wastepiece W from the cut component to form the oppositely, 45°, angular cut ends component C (shown in FIG. 6).

To further explain the above relationship, reference may be had to the schematic illustration of FIG. 7 in which the second leg member 42 is shown in position for acting as an abutment stop for the leading end of the strip of material M in which a component cut therefrom in that position would have 0 inside edge length L1. As may be clearly seen therein, an isosceles right triangular wastepiece W of an inside edge length L2 has been added to the portion of the strip of material M positioned outwardly along its longitudinally extending axis past the slot 13 which represents the axis along which the saw will cut the strip of material M. This schematic illustration also illustrates a right triangle having one side thereof of a length Y corresponding to the width of the strip of material M and the other side thereof of a length 3Y and an included angle between the hypotenuse of the triangle and the long side of 18° 26′. This triangular relationship is necessary for compensatively adding the necessary additional inside edge length L2 to provide an initially cut component of the proper inside edge length L1 + L2 for the subsequent cutting off and removing of only a minimum waste, isosceles right triangular, wastepiece W which removes the inside edge length L2. In the position of the leg members 42, 32 for the relationship shown in FIG. 7, the scale 50 carried by the leg member 32 would be at 0 point at the indicator 51 so that the leg member 32 may be moved outwardly a desired length L1 as read on the scale 50 to add the desired length L1 for the inside edge of the component C being cut.

Thus, this invention has provided, in combination, an apparatus 10 for cutting workpieces, such as components C for making mitered corner picture frames, from an elongate strip of material M of any predetermined width, in which each workpiece has opposing ends E1, E2 which are equally and oppositely, preferably 45°, angled with respect to each other and an inside edge I of predetermined length and means 30 for (1) providing a stop for properly positioning the strip of material M regardless of the width thereof before each cut for making the next workpiece, and (2) measuring the ultimate desired inside edge length L1 of each workpiece to be cut from the strip of material M while compensatively adding the necessary additional inside edge length L2 to the workpiece being cut to provide an initially cut workpiece of the proper combined inside edge length L1 + L2 for the subsequent cutting off of only a minimum waste, preferably isosceles right triangular shaped, wastepiece W which removes the additional inside edge length L2 and provides a final cut component C of the desired inside edge length L1.

In the drawings and specification, there has been set forth a preferred embodiment of the invention, and although specific terms are employed, they are used in a generic and descriptive sense only and not for purposes of limitation.

What is claimed is:

1. An apparatus for easily and quickly cutting with minimum waste workpieces, such as components for making mitered corner picture frames, from an elongate strip of material of any predetermined width, in which each workpiece has opposing ends which are equally and oppositely angled with respect to each other and an inside edge of predetermined length; said apparatus comprising:

guide means for positioning the elongate strip of material at desired positions along a longitudinally extending axis;

saw means cooperating with said guide means for making spaced, successive, angular, parallel cuts through the elongate strip to form workpieces with parallel angular cut ends and for thereafter cutting off and removing a wastepiece from one end of each cut workpiece by making an oppositely angled cut; and means operatively positioned and associated with said guide means and said saw means for (1) providing a stop for properly positioning the strip of material regardless of the width thereof before each cut for making the next workpiece, and (2) measuring the ultimate desired inside edge length of each workpiece to be cut from the strip of material while compensatively adding the necessary additional inside edge length to the workpiece being cut to provide an initially cut workpiece of the proper combined inside edge length for the subsequent cutting off of only a minimum waste, triangular shaped, wastepiece which removes the additional inside edge length.

2. An apparatus, as set forth in claim 1, in which said stop and measuring means comprises a first elongate leg means adjustably mounted along an outwardly longitudinally extending axis parallel with the axis along which the strip of material is positioned by said guide means and having an outer end; and a second elongate leg means connected with said first leg means at said outer end thereof for movement therewith and being adjustably mounted along an inwardly longitudinally extending axis disposed at a predetermined included acute angle with the axis along which said first leg means is mounted and having an inner end for receiving and acting as an abutment stop for the outer corner of the leading cut end of the strip of material, so that, when said first leg means is adjusted to a desired position along its axis in relation to the desired inside edge length of the workpiece being cut and said second leg means is adjusted to a desired position along its axis in relation to the width of the strip of material being cut for aligning with the outer corner of the leading cut end of the strip of material, the strip of material will be properly positioned for making the next workpiece.

3. An apparatus, as set forth in claim 2, in which said first elongate leg means of said stop and measuring means includes a scale carried by said first leg means along at least a portion of the length thereof for providing a visual indication for adjustment of said first leg means to the desired position along its axis in relation to the desired inside edge length of the workpiece being cut.

4. An apparatus for easily and quickly cutting with minimum waste workpieces, such as components for making mitered corner picture frames, from an elongate strip of material of any predetermined width, in which each workpiece has opposing ends which are 45° and oppositely angled with respect to each other and an inside edge of predetermined desired length; said apparatus comprising:

guide means for positioning the elongate strip of material at desired positions along a longitudinally extending axis;

saw means cooperating with said guide means for making spaced, successive, parallel, 45° cuts through the elongate strip to form workpieces with parallel 45° cut ends and for thereafter cutting off and removing a wastepiece from one end of each cut workpiece by making an oppositely angled, 45° cut; and means operatively positioned and associated with said guide means and said saw means for (1) providing a stop for properly positioning the strip of material regardless of the width thereof before each 45° cut for making the next workpiece, and (2) measuring the ultimate desired inside edge length of each workpiece to be cut from the strip of material while compensatively adding the necessary additional inside edge length to the workpiece being cut to provide an initially cut workpiece of the proper combined inside edge length for the subsequent cutting off of only a minimum waste, isosceles right triangular shaped, wastepiece which removes the additional inside edge length.

5. An apparatus, as set forth in claim 4, in which said stop and measuring means comprises a first elongate leg means adjustably mounted along an outwardly longitudinally extending axis parallel with the axis along which the strip of material is positioned by said guide means and having an outer end, and a second elongate leg means connected with said first leg means at said outer end thereof for movement therewith and being adjustably mounted along an inwardly longitudinally extending axis disposed at an included angle of approximately 18° 26' with the axis along which said first leg means is mounted and having an inner end for receiving and acting as an abutment stop for the outer corner of the leading cut end of the strip of material, so that, when said first leg means is adjustably positioned to a desired position along its axis in relation to the desired inside length of the workpiece being cut and said second leg means is adjusted to a desired position along its axis in relation to the width of the strip of material being cut for aligning with the outer corner of the leading cut end of the strip of material, the strip of material will be properly positioned for making the next workpiece.

6. An apparatus, as set forth in claim 5, in which said first elongate leg means of said stop and measuring means includes a scale carried by said first leg means along a portion of the length thereof for providing a visual indication for adjustment of said first leg means to the desired position along its axis in relation to the desired inside edge length of the workpiece being cut.

7. An apparatus, as set forth in claim 5, in which said second leg means of said stop and measuring means includes a bracket member secured to the inner end thereof for receiving the outer corner of the leading cut end of the strip of material.

8. An apparatus for easily and quickly cutting with minimum waste workpieces, such as components for making mitered corner picture frames, from an elongate strip of material of any predetermined width, in which each workpiece has opposing ends which are 45° and oppositely angled with respect to each other and an inside edge of predetermined desired length; said apparatus comprising:

a stationary support frame structure;

a table top linearly movably mounted on said support frame and having a longitudinally extending slot generally medially thereof;

a rotating, circular saw mounted in fixed position on said support frame and positioned within a portion of said slot of said table top so that said table top may be moved linearly back and forth with respect thereto;

a longitudinally extending backstop means secured to said table top and disposed at a substantially 135° included angle with respect to said table top slot and said saw for receiving the inside edge of the strip of material thereagainst and positioning the strip of material along a longitudinally extending axis at the substantially same angle with respect to said saw for movement of said table top and the strip of material linearly toward said saw for making spaced, successive, parallel, 45° cuts through the elongate strip to form workpieces with parallel 45° cut ends in which each of the workpieces may thereafter have a wastepiece cut off and removed from one end thereof by making an oppositely angled 45° cut through the workpiece;

releasable clamp means mounted on said table top for being selectively positioned in engagement with the outside edge of the strip of material received by said backstop means for clamping the strip of material against said backstop means during each cutting operation; and means operatively positioned and associated with said backstop means and said saw means for (1) providing a stop for properly positioning the strip of material regardless of the width thereof before each 45° cut for making the next workpiece, and (2) measuring the ultimate desired inside edge length of each workpiece to be cut from the strip of material while compensatively adding the necessary additional inside edge length to the workpiece being cut to provide an initially cut workpiece of the proper combined inside edge length for the subsequent cutting off of only a minimum waste, isosceles right triangular shaped, wastepiece which removes the additional inside edge length.

9. An apparatus, as set forth in claim 8, in which said stop and measuring means comprises:

a first elongate leg means carried by said table top and mounted along an outwardly longitudinally extending axis parallel with and spaced from the axis along which the strip of material is positioned by said backstop means and having an outer end thereon, and a second elongate leg means connected with said first leg means at said outer end thereof for movement therewith and being adjustably mounted along an inwardly longitudinally extending axis disposed at an included angle of approximately 18° 26' with the axis along which said first leg means is mounted and having an inner end for receiving and acting as an abutment stop for the outer corner of the leading cut end of the strip of material, so that, when said first leg means is adjustably positioned to a desired position along its axis in relation to the desired inside length of the workpiece being cut and said second leg means is adjusted to a desired position along its axis in relation to the width of the strip of material being cut for aligning with the outer corner of the leading cut end of the strip of material, the strip of material will be properly positioned for making the next workpiece.

10. An apparatus, as set forth in claim 9, in which said first leg means of said stop and measuring means includes a scale carried by said first leg means along a portion of the length thereof for providing a visual indication for adjustment of said first leg means to the desired position along its axis in relation to the desired inside edge length of the workpiece being cut.

11. An apparatus for easily and quickly cutting with minimum waste workpieces, such as components for making mitered corner picture frames, from an elongate strip of material of any predetermined width, in which each workpiece has opposing ends which are 45° and oppositely angled with respect to each other and an inside edge of predetermined desired length; said apparatus comprising:

a stationary support frame structure;

a table top linearly movably mounted on said support frame and having a longitudinally extending slot generally medially thereof;

a rotating, circular saw mounted in fixed position on said support frame and positioned within a portion of said slot of said table top so that said table top may be moved linearly back and forth with respect thereto;

a first longitudinally extending backstop means secured to said table top and disposed at a substantially 135° included angle with respect to said table top slot and said saw for receiving the inside edge of the strip of material thereagainst and positioning the strip of material along a longitudinally extending axis at the substantially same angle with respect to said saw for movement of said table top and the strip of material linearly toward said saw for making spaced, successive, parallel, 45° cuts through the elongate strip to form workpieces with parallel 45° cut ends;

a second longitudinally extending backstop means secured to said table top and disposed at a substantially 135° included angle with respect to said table top slot and said saw and at a substantially 90° included angle with respect to said first backstop means for receiving the inside edge of each of the cut workpieces thereagainst and positioning the workpiece at the substantially same angle with respect to said saw for movement of said table top and the workpiece linearly toward said saw for making an oppositely angled, 45° cut at one end of the component to cut off and remove a wastepiece; and means operatively positioned and associated with said first backstop means and said saw for (1) providing a stop for properly positioning the strip of material regardless of the width thereof before each 45° cut for making the next workpiece, and (2) measuring the ultimate inside edge length of each workpiece to be cut from the strip of material while compensatively adding the necessary additional inside edge length to the workpiece being cut to provide an initially cut workpiece of the proper combined inside edge length for the subsequent cutting off of only a minimum waste, isosceles right triangular shaped, wastepiece which removes the additional inside edge length.

12. An apparatus, as set forth in claim 11, further including a first releasable clamp means mounted on said table top for being selectively positioned in engagement with the outside edge of the strip of material received by said first backstop means for clamping the strip of material against said first backstop means during each cutting operation, and second releasble clamp means mounted on said table top for being selectively positioned in engagement with the outside edge of the cut workpiece received by said second backstop means for clamping the workpiece against said second backstop means during the cutting operation.

13. An apparatus, as set forth in claim 12, in which said stop and measuring means comprises:

a first elongate leg means carried by said table top and adjustably mounted along an outwardly longitudinally extending axis parallel with and spaced from the axis along which the strip of material is positioned by said first backstop means and having an outer end thereon, and a second elongate leg means connected with said first leg means at said outer end thereof for movement therewith and adjustably positioned along an inwardly longitudinally extending axis disposed at an included angle of approximately 18° 26' with the axis along which said first leg means is mounted and having an inner end for receiving and acting as an abutment stop for the outer corner of the leading cut end of the strip of material so that, when said first leg means is adjustably positioned to a desired position along its axis in relation to the desired inside length of the workpiece being cut and said second leg means is adjusted to a desired position along its axis in relation to the width of the strip of material being cut for aligning with the outer corner of the leading cut end of the strip of material, the strip of material will be properly positioned for making the next workpiece.

* * * * *